United States Patent [19]

Kishimoto et al.

[11] 4,009,248

[45] Feb. 22, 1977

[54] PROCESS FOR PRODUCING CARBON FIBERS

[75] Inventors: Soichiro Kishimoto; Saburo Okazaki, both of Okayama, Japan

[73] Assignee: Japan Exlan Company Limited, Osaka, Japan

[22] Filed: Mar. 31, 1976

[21] Appl. No.: 672,534

[30] Foreign Application Priority Data

Apr. 4, 1975 Japan ..... 50-41400

[52] U.S. Cl. ..... 423/447.4; 264/29.2; 423/447.6; 423/447.7

[51] Int. Cl.[2] ..... D01F 9/12

[58] Field of Search ..... 423/447.4, 447.6, 447.7; 264/29.1, 29.6, 29.2

[56] References Cited

UNITED STATES PATENTS

| | | | |
|---|---|---|---|
| 2,697,028 | 12/1954 | Baker et al. | 264/29.6 |
| 3,689,220 | 9/1972 | Smudski | 423/447.4 |
| 3,767,773 | 10/1973 | Turner et al. | 423/447.4 |

FOREIGN PATENTS OR APPLICATIONS

| | | | |
|---|---|---|---|
| 2,363,415 | 7/1974 | Germany | 423/447.2 |

*Primary Examiner*—Oscar R. Vertiz
*Assistant Examiner*—Wayne A. Langel
*Attorney, Agent, or Firm*—Wenderoth, Lind & Ponack

[57] ABSTRACT

Carbon fibers having excellent properties are produced by a process which comprises thermal-stabilizing and carbonizing acrylonitrile fibers containing certain aminosiloxanes.

12 Claims, No Drawings

PROCESS FOR PRODUCING CARBON FIBERS

The present invention relates to a process for producing, in an industrially advantageous manner, a carbon fiber of excellent properties that can be used beneficially as a reinforcing material. More specifically, the invention relates to a process which comprises using, as the starting material (so-called "precursor" for obtaining the carbon fiber), an acrylonitrile fiber which has been made to contain (optionally by means of impregnation) a particular aminosiloxane in the fiber production step, thereby providing a markedly increased operation efficiency in the production of the precursor fiber and the carbon fiber and producing in an extremely short firing time a carbon fiber of excellent properties which has an intimate adhering affinity to resins.

It is already well known to obtain carbon fibers which are excellent for use in reinforcing materials, exothermic elements, refractory materials, etc. by heating an acrylonitrile fiber in an oxidizing atmosphere at a temperatures between 200° and 400° C. so as to form a cyclized structure in the fiber, followed by firing the cyclized fiber in a non-oxidizing atmosphere at higher temperatures (normally above 800° C.).

However, the so-called thermal stabilization step, which is the step of forming naphthyridine rings in the acrylonitrile fiber by heating the fiber in an oxidizing atmosphere, is a very important step that governs the physical properties of the carbon fiber, the final product. It has been thought that this step requires a long-time heating operation, and this has been the cause of low productivity of carbon fibers.

If a condition of high-temperature thermal stabilization or an operation with a sharp temperature rise is employed in order to elevate the productivity of the carbon fiber, abrupt reactions such as intermolecular cross-linkage and intramolecular cyclization will occur at a temperature in the vicinity of the exothermic transition point of the fiber. Accompanied with such reactions, local accumulation of heat takes place which causes an uneven reaction to produce a pitch-like or tar-like substance. Such a substance causes mutual adhesion of filaments or exerts an evil influence on the physical properties of the carbon fiber, for example a decrease in mechanical strength.

Therefore, various processes have been proposed to accelerate the cyclization reaction so that thermally stabilized fibers can be obtained in a short time. All these processes, however, have not necessary contributed to the improvement in economy and industrial productivity of carbon fibers of excellent physical properties, because such processes are those copolymerizing a special comonomer with the fiber-forming polymer, or employing a treatment with a special or harmful chemical, or employing a complicated thermal stabilization step.

As regards the prevention of fiber fusion upon heat treatment, a process is proposed in Japanese Laid-Open patent application Ser. No. 117725/1974, wherein a long-chain silicone oil is applied to the fiber and then the fiber is subjected to thermal stabilization or thereafter further to carbonization. However, the application of the mentioned oil in the fiber production step is not effective enough to prevent the static electricity generated by friction with rollers or the like, and this gives rise to troubles such as filament fluffiness, spreading and breakage. Also, the application of said oil exerts hardly any effect on the acceleration of thermal stabilization reactions such as cross-linkage and cyclization in the thermal stabilization step, thus falling in the improvement in the productivity of carbon fibers by means of the sharp temperature rise operation.

On the other hand, in carbon fibers, fine voids remain which have been generated upon producing precursor fibers or upon firing. When such carbon fiber is exposed to as external force, cracks may develop with such voids as the centers. Thus, there may be cases where the excellent properties which the carbon fiber intrinsically possesses are not fully displayed so that it is difficult to obtain a product having an expected strength. In addition, because carbon fibers generally have a poor adhering affinity to matrices such as resins, carbon fibers are often subjected to surface treatment in various way in order to elevate the shear strength which they will have when they are produced into a composite material. Such treatment may lower the physical properties which the carbon fibers intrinsically possess or forms a cause of high costs.

In the light of such a situation of the prior techniques, we made an intensive study to overcome the above-mentioned defects and to obtain high quality carbon fibers in an industrially advantageous manner. As a result, we have found that, by using as the precursor fiber for obtaining carbonized fiber, an acrylonitrile fiber which has been made to contain (optionally by means of impregnation) a particular aminosiloxane in the fiber production step and then heating the fiber, all troubles such as fluffiness, spreading and breakage of the precursor filaments are completely removed, the heating time is shortened to a great extent, and at the same time carbon fibers of excellent physical properties having a good adhering affinity to matrices can be produced in an industrial manner. This discovery led to the present invention.

The main object of the present invention is to obtain carbon fibers having excellent physical properties in an industrially advantageous manner.

An object of the present invention is to provide a process whereby such troubles as fluffiness, spreading and breakage of the precursor filaments are removed and a carbon fiber of high tensile strength and high modulus of elasticity can be produced within a short heating time.

Another object of the present invention is to improve the properties of mutual separation between the precursor filaments and to elevate the adhering affinity between the carbon fiber obtained and matrices, thereby producing a carbon fiber which can exhibit its excellent properties effectively.

Other objects of the present invention will become apparent from the following concrete explanation.

These objects of the present invention are achieved by a process wherein an acrylonitrile fiber which has been made to contain (optionally by means of impregnation) at least 0.01%, based on the weight of the fiber, of an aminosiloxane represented by the following general formula:

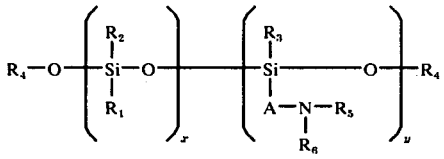

wherein $R_1$ is a hydrogen atom, a lower alkyl group or an aryl group; $R_2$ and $R_3$ are each a lower alkyl group or an aryl group; $R_4$ is a hydrogen atom or a group of

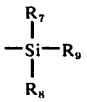

wherein $R_7$ and $R_8$ are each a lower alkyl group and $R_9$ is a hydrogen atom or a lower alkyl group); $R_5$ and $R_6$ are each a hydrogen atom or a lower alkyl group; and A is an alkylene group containing 2 to 5 carbon atoms or phenylene group, and $x$ and $y$ are positive integers which provide a molecular weight of the aminosiloxane of not more than 100,000, is fired or heated in the usual way to carbonize the fiber or further graphatize the carbonized fiber thus obtained.

It is supposed that, by introducing the particular aminosiloxane according to the present invention into the acrylonitrile fiber, initiating points of cross-linking, cyclizing and dehydrating reactions might become liable to be formed within the fiber upon firing, by means of the amino side-chains of the aminosiloxane. Such initiating points may accelerate the intramolecular cyclization reaction of nitrile groups, dehydration reaction and cross-linking reaction by oxidation in the thermal stabilization step and make these reactions proceed moderately to the core of the fiber. Therefore, the exothermic reaction accompanying the deterioration and decomposition of the fiber can be effectively controlled. Accordingly, it is now possible to shorten the firing time to a great extent by the employment of the thermal stabilization condition based on the sharp temperature rise operation.

Further, since the above-mentioned aminosiloxane is given to acrylonitrile fibers in the fiber production step, the generation of static electricity due to friction by rollers and the like is effectively suppressed. Thus troubles such as filament breakage, fluffiness and spreading are removed so that efficiency in continuous operation in the production of acrylonitrile precursor fibers and the stability in quality thereof can be markedly improved.

Furthermore, it is supposed that, according to the present invention, a suitable silicone structure is introduced into the fiber voids which have been generated during the production of the fiber or during the heat treatment thereof, and said silicone structure may be onverted into a SiC structure during the firing step to form strong bonds so that cracks, which otherwise may develop with the voids as centers, might be favorably suppressed, with the result that carbon fibers of excellent properties can be obtained. It is also an important feature of the present invention that the carbon fiber obtained in accordance with the present invention has a good adhering affinity to matrices such as resins so that the properties inherent to the carbon fiber can be advantageously displayed in carbon fiber composite materials.

The acrylonitrile fibers used in the present invention are those produced from acrylonitrile homopolymers or acrylonitrile copolymers containing acrylonitrile in an amount of at least 85 mol percent, preferably not less than 90 mol percent. Among the copolymeric components there may be mentioned well-known ethylenically unsaturated compounds such as allyl alcohol, methallyl alcohol, hydroxyalkylacrylonitriles, acrylic acid, methacrylic acid, itaconic acid, crotonic acid, methacrylonitrile, $\alpha$-methyleneglutaronitrile, isopropenyl acetate, acrylamide, N-methylolacrylamide, $\beta$-hydroxyethyl methacrylate, dimethylaminoethyl methacrylate, vinylpyridine, vinylpyrrolidone, methyl acrylate, methyl methacrylate, vinyl acetate, allyl chloride, sodium methallysulfonate, potassium p-styrenesulfonate, etc. Such a homopolymer or copolymer of acrylonitrile is generally produced in the well-known polymerization systems such as solvent polymerization system, mass polymerization system, emulsion polymerization system or suspension polymerization system. The solvents used upon producing acrylonitrile fibers from these polymers include organic solvents such as dimethylformamide, dimethylacetamide and dimethyl sulfoxide; and inorganic solvents such as aqueous solutions of nitric acid, zinc chloride and thiocyanates. Such a polymer solution is spun to form filaments in the usual way.

As the methods for applying the particular aminosiloxane to acrylonitrile fibers according to the present invention, a method wherein the aminosiloxane is added to the spinning solution which is thereafter spun, or a method wherein an acrylonitrile fiber in a water-swollen state obtained by spinning is treated with the aminosiloxane to impregnate the fiber with it, is preferably used. The water-swollen fiber can be advantageously produced generally by the usual wet-spinning process or by the dry-wet spinning process which comprises extruding the spinning solution through a spinnerette into an inert gas atmosphere, followed by introducing the extruded spinning solution into an aqueous coagulating bath to coagulate it into filaments.

The particular aminosiloxane used in the present invention is a random copolymer consisting essentially of substituted siloxyl and aminosiloxyl recurring units, as shown by the above-mentioned general formula, and a liquid polymer having a molecular weight of not more than 100,000 is generally used. The lower limit of such an aminosiloxane should be generally about 2000, and it is preferable that the ratio ($x : y$) of the substituted siloxyl units ($x$) to the aminosiloxyl units ($y$) should be 4–200 : 1. The lower alkyl groups selected as $R_1$, $R_2$, $R_3$, $R_5$, $R_6$, $R_7$, $R_8$ and $R_9$ are generally those having 1–6 carbon atoms, and those having not more than 4 carbon atoms are used preferably.

It is necessary that such an aminosiloxane should be introduced into the acrylonitrile fiber in an amount of at least 0.01%, preferably at least 0.05% based on the weight of the fiber. With an amount of introduction of less than 0.01%, it is difficult to sufficiently display the effect of the present invention. On the other hand, introduction of too much an amount of the aminosiloxane is not economical since no better effect is expected. Therefore, it is desired that the upper limit of the amount of introduction of the aminosiloxane should be in the order of about 5% based on the weight of the fiber.

In actual practice, upon applying such an aminosiloxane to a water-swollen acrylonitrile fiber, a method is preferably employed wherein the fiber is treated with an emulsion obtained by emulsifying the aminosiloxane with a suitable emulsifying agent. Further, it is possible to use a disperse medium except water, or to treat the fiber directly with a single aminosiloxane or a mixture of aminosiloxanes, or to treat the fiber with a solution of the aminosiloxane in a solvent such as chlorinated hydrocarbons, petroleum ether, n-hexane, cyclohexane, or benzene, etc.

The water-swollen fiber to which the aminosiloxane may be applied means a gel fiber obtained by spinning, after having been subjected to water-washing and stretching generally at a ratio above 3 times, preferably above 4 times in hot water and/or heated steam and before drying. Especially, to make the aminosiloxane penetrate uniformly and sufficiently into the interior of the fiber, it is desirable that the gel fiber should have a water content of from 20 to 200% based on the dry weight of the fiber. The aminosiloxane emulsion which may be preferably used upon the treatment of the water-swollen fiber can be generally prepared using as the emulsifier, a POE (n) alkylphenyl phosphate (wherein POE is polyoxyethylene and *n* is an integer of 5–15 and shows the degree of polymerization of the polyoxyethylene) such as POE (8) octylphenyl phosphate, POE (9) octylphenyl phosphate, POE (8) nonylphenyl phosphate, POE (9) nonylphenyl phosphate or POE (10) dodecylphenyl phosphate.

Upon producing carbon fibers from the acrylonitrile fiber which has been made to contain such a particular aminosiloxane, any known firing method may be employed. Generally, however, a firing method is preferred which comprises a first firing step (so-called thermal stabilization step) in which the fiber is heated at 150° to 400° C. in an oxidizing atmosphere and a second firing step in which the thermally stabilized fiber is heated at higher temperatures (normally above 800° C.) in a non-oxidizing atmosphere or under reduced pressure to carbonize the fiber or thereafter to graphitize the carbon fiber. Although air is suitable as the atmosphere for use in thermal stabilization, the fiber may be thermally stabilized in the presence of sulfur dioxide or nitrogen monoxide or under irradiation of light. The carbonizaton is conducted generally at a temperature of 800°–2000° C., and the graphitization is conducted generally at a temperature of 2000°–3500° C. Among the atmospheres for use in carbonization or graphitization, nitrogen, hydrogen, helium and argon are preferred. To obtain a carbon fiber having a better tensile strength and modulus of elasticity, it is preferable to heat the fiber under tension (normally 0.1 to 0.5 g/d) as is generally known. It is particularly effective to apply tension at the time of thermal stabilization and carbonization graphitization. The carbonization or graphitization may be carried out under reduced or increased pressure.

By employing such a process of the present invention, it is now possible to produce a carbon fiber which is very excellent in tensile strength and modulus of elasticity at a high production efficiency and in a short time. Accordingly, the carbon fiber having such excellent properties can be advantageously used in the wide field of reinforcing materials, exothermic elements, refractory materials, etc.

For a better understanding of the present invention, representative examples of the present invention are set forth hereinafter. The percentages and parts in the examples are by weight unless otherwise specified.

EXAMPLE 1

A spinning solution obtained by dissolving 15 parts of an acrylonitrile copolymer consisting of 98% acrylonitrile and 2% acrylic acid in 85 parts of a 48% aqueous sodium thiocyanate solution, was extruded through a spinnerette into a 12% aqueous sodium thiocyanate solution to form coagulated filaments. Thereafter, the fiber was washed with water in the usual way and then stretched four times the length in boiling water and further stretched two times in superheated steam to obtain an acrylonitrile fiber in a water-swollen state having a water content of 135%.

The water-swollen fiber was then immersed into an aqueous emulsion (pH = 6.8) consisting of 100 parts of an aminosiloxane ($NH_2$ content = 0.5%) represented by the following formula:

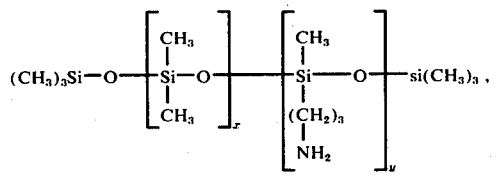

50 parts of nonylphenyl phosphate and 4 parts of zinc acetate as the catalyst. Thereafter, the fiber was subjected to a drying operation with heated rollers at 120° C. for 4 seconds to obtain an acrylonitrile fiber containing 0.3% aminosiloxane. The thus obtained fiber was free from inconvenience such as filament fluffiness, breakage and spreading, and thus it was very excellent as a precursor fiber for producing carbon fibers.

The acrylonitrile fiber thus obtained was subjected to thermal stabilization treatment by passing the fiber continuously through an electric furnace having a continuous temperature gradient of from 200° C. to 280° C., in an air atmosphere, under a tension of 0.3 g/d, for 25 minutes. The thermally stabilized fiber was then carbonized by passing the fiber continuously through an electric furnace having a temperature gradient of from 300° C. to 1300° C., in a nitrogen atmosphere for 60 seconds. The thus-obtained carbon fiber had very excellent physical properties, with a tensile strength of 300 kg/mm² and a modulus of elasticity of 27 t/mm².

On the other hand, when the water-swollen fiber was subjected to drying operation with dry-heated rollers, without the aminosiloxane treatment, troubles such as fluffiness, spreading and breakage of the filaments occurred frequently, thus making continuous operation difficult. Additionally, the above-mentioned water-swollen fiber was immersed in an aqueous sorbitan laurate solution and then subjected to the same drying operation to produce an acrylonitrile fiber containing 0.3% sorbitan laurate. This fiber was carbonized according to the above-mentioned carbonizing conditions. The thus-obtained carbon fiber had poor physical properties as low as a tensile strength of 232 kg/mm² and a modulus of elasticity of 21 t/mm².

EXAMPLE 2

The water-swollen acrylonitrile fiber obtained in Example 1 was immersed in treating liquids of the following formulations (A) to (C) and then dried under the same conditions as in Example 1. Three kinds of precursor fibers were obtained.

Formulations

A. The aqueous aminosiloxane emulsion used in Example 1,
B. An aqueous solution of POE (9) nonylphenyl phosphate, and
C. An aqueous emulsion obtained by emulsifying dimethyl polysiloxane with POE (9) nonylphenyl phosphate.

Thereafter, these fibers were heat-treated under the same thermal stabilization and carbonization conditions as in Example 1. The fiber to which the (A) or (B) formulation was applied produced a carbon fiber without any trouble, but the fiber to which the (C) formulation was applied was broken during the thermal stabilization treatment and it was impossible to subject it to the following carbonizing treatment. Therefore, only for the fiber to which the formulation (C) was applied, the thermal stabilization time was prolonged for 50 minutes.

The physical properties of the three kinds of carbon fibers are shown in Table 1. It will be understood that, by using the acrylonitrile fiber which has been made to contain the aminosiloxane, a carbon fiber of excellent physical properties can be produced rapidly. The use of dimethyl polyaminosiloxane containing no amino group did not realize the shortening of the thermal stabilization time, and also did not sufficiently contributed to the improvement of the carbon fiber.

Table 1

| | | Fiber treated with (A) | Fiber treated with (B) | Fiber treated with (C) |
|---|---|---|---|---|
| Physical properties of carbon fiber | Tensile strength (kg/mm²) | 305 | 213 | 219 |
| | Modulus of elasticity (t/mm²) | 27 | 22 | 22 |

EXAMPLE 3

The water-swollen acrylonitrile fiber obtained in Example 1 was immersed in aqueous emulsion in various concentrations of the same aminosiloxane as used in Example 1 and was dried with drying rollers at 120° C. for 4 seconds, whereby various acrylonitrile fibers of different aminosiloxane contents were obtained. These fibers were then carbonized under the conditions in Example 1. The physical properties of the carbon fibers are shown in Table 2.

Table 2

| Aminosiloxane content (%) in the acrylonitrile fiber | Properties of the carbon fiber: Strength (kg/mm²) | Modulus of elasticity (t/mm²) |
|---|---|---|
| 0.03 | 256 | 24 |
| 0.04 | 291 | 26 |
| 0.3 | 300 | 27 |
| 2.9 | 312 | 26 |
| 4.5 | 270 | 26 |

EXAMPLE 4

A spinning solution obtained by dissolving 15 parts of an acrylonitrile copolymer consisting of 98% acrylonitrile and 2% acrylic acid in 80 parts of a 8% aqueous solution of sodium thiocyanate, was extruded into air through a spinnerette having 1000 orifices and then introduced into a 12% aqueous solution of thiocyanate to form coagulated filaments. Thereafter, the fiber was washed with water in the usual was and then stretched 3 times the length in hot water, whereby a water-swollen acrylonitrile fiber having a water content of about 160% was obtained.

The water-swollen fiber was then treated with the aqueous aminosiloxane emulsion used in Example 1, and thereafter stretched two times the length in saturated steam at 130° C., whereby Fiber D was obtained. On the other hand, the water-swollen fiber was subjected to two times stretching only, without the aminosiloxane treatment, whereby Fiber E was obtained. These fibers were dried in the usual way. Fiber D contained 0.5% aminosiloxane.

The two kinds of fibers thus obtained were thermally stabilized by heating continuously to 280° C. under the various temperature rise conditions shown in Table 3, through the electric furnace used in Example 1, in air atmosphere, under a tension of 0.24 g/d. The thermally stabilized fibers were then carbonized in a nitrogen atmosphere under the conditions in Example 1. The physical properties of the carbon fibers are shown in Table 3. By following the process of the present invention, it is now possible to provide a shortened time of the thermal stabilization step and to produce carbon fibers of excellent physical properties at a high production efficiency.

Table 3

| | Fiber D | | | Fiber E | | |
|---|---|---|---|---|---|---|
| Temperature rise speed upon thermal stabilization | 1° C/min | 2° C/min | 4° C/min | 1° C/min | 2° C/min | 4° C/min |
| Tensile strength (kg/mm²) | 238 | 315 | 308 | 24.5 | 196 | Measurement was impossible because of fiber fusion |
| Modulus of elasticity (t/mm²) | 27 | 29 | 29 | 23 | 18 | |

One of the carbon fibers obtained from Fiber D (that obtained at the temperature rise speed of 1° C/min) and one of the carbon fibers obtained from Fiber E (that obtained at the temperature rise speed of 1° C/min) were used respectively as a reinforcing material to produce fiber-reinforced resins. The resin reinforced with the former carbon fiber according to the present invention showed a shear strength of 9.3 kg/mm², while that of the resin reinforced with the former conventional carbon fiber was only 6.2 kg/mm². As the resin and hardener, an epoxy thermosetting resin Epicoat No. 828 (Shell Chemical) and a hardner DMP-30 (Shell Chemical) were used. A curing treatment condition of 90° C. for one hour and a post-curing condition of 170° C. for two hours were employed. The filling amount of the carbon fiber was 65 volume percent.

EXAMPLE 5

Upon dissolving an acrylonitrile copolymer containing 98% acrylonitrile in an aqueous solution of sodium thiocyanate, a random copolymer consisting of dimethyl siloxyl units and methyl aminopropyl siloxyl units, having trimethyl silyl groups at the ends (in the above-mentioned general formula, $R_1$ to $R_3 = -CH_3$; $R_4 = -Si(CH_3)_3$; $A = -(CH_2)_3-$; $R_5$ to $R_6 = H$; $x + y = 200$; $NH_2$ content = 1.8%), was mixed by 0.2% based on said copolymer and dispersed finely in the spinning solution. Thereafter, according to the method in Example 1, the spinning solution was spun into filaments, which were then washed with water, stretched and dried, whereby an acrylonitrile fiber was obtained. The operation proceeded with no troubles occurring in the drying step. The content of the aminosiloxane in said fiber was 0.18%.

This acrylonitrile fiber was carbonized according to the method used in Example 1, whereby a carbon fiber of excellent physical properties was obtained which had a tensile strength of 281 kg/mm² and a modulus of elasticity of 27 t/mm².

What we claim is:

1. In a process for producing carbon fibers which comprises heating acrylonitrile fibers made from an acrylonitrile homopolymer or an acrylonitrile copolymer containing at least 85 mole % acrylonitrile, the improvement wherein the acrylonitrile fiber contains at least 0.01%, based on the weight of the fiber, of an aminosiloxane of the formula:

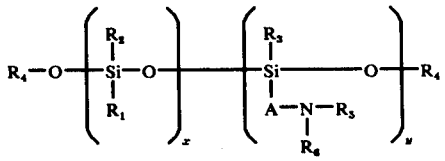

wherein $R_1$ is hydrogen or a lower alkyl or aryl group, $R_2$ and $R_3$ are lower alkyl or aryl groups, $R_4$ is hydrogen or a group of

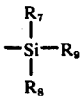

wherein $R_7$ and $R_8$ are lower alkyl groups, $R_9$ is hydrogen or a lower alkyl group, $R_5$ and $R_6$ are hydrogens or lower alkyl groups, A is an alkylene group having two to five carbon atoms or a phenylene group, $x$ and $y$ are positive integers and the molecular weight of the aminosiloxane is not more than 100,000.

2. The improvement as claimed in claim 1, wherein the acrylonitrile fiber is a fiber produced by treating an acrylonitrile fiber in a water-swollen state with the aminosiloxane.

3. The improvement as claimed in claim 2, wherein the acrylonitrile fiber in a water-swollen state is treated with an aqueous emulsion of the aminosiloxane.

4. The improvement as claimed in claim 3, wherein the aqueous emulsion of the aminosiloxane contains an emulsifier selected from the group consisting of polyoxyethylene (n) alkylphenyl phosphates wherein *n* is the polymerization degree of polyoxyethylene and is an integer of from 5 to 15.

5. The improvement as claimed in claim 2, wherein the acrylonitrile fiber in a water-swollen state contains 20 to 200%, based on the dry weight of the fiber, of water.

6. The improvement as claimed in claim 1, wherein the acrylonitrile fibers are thermally stabilized in an oxidizing atmosphere at a temperature of 150° to 400° C. and are then carbonized in a non-oxidizing atmosphere at a temperature of 800° to 2000° C.

7. The improvement as claimed in claim 6, wherein the oxidizing atmosphere is air.

8. The improvement as claimed in claim 6, wherein the non-oxidizing atmosphere is nitrogen.

9. The improvement as claimed in claim 6, wherein the thermally stabilized fibers are carbonized in a non-oxidizing atmosphere at a temperature of 800° to 2000° C. and are then graphitized in a non-oxidizing atmosphere at a temperature of 2000° to 3500° C.

10. The improvement as claimed in claim 1, wherein the acrylonitrile fiber is a fiber made from an acrylonitrile copolymer containing at least 90 mole % acrylonitrile.

11. The improvement as claimed in claim 1, wherein the acrylonitrile fiber contains at least 0.05%, based on the weight of the fiber, of the aminosiloxane.

12. The improvement as claimed in claim 1, wherein the acrylonitrile fiber contains not more than about 5%, based on the weight of the fiber, of the aminosiloxane.

* * * * *